US005862436A

United States Patent [19]

Ishizawa et al.

[11] Patent Number: 5,862,436

[45] Date of Patent: Jan. 19, 1999

[54] FIXING APPARATUS AND METHOD FOR ELECTROPHOTOGRAPHIC APPARATUS INCLUDING TEMPERATURE DETECTING MECHANISM FOR HEAT ROLLER

[75] Inventors: Katsumi Ishizawa; Shuho Yokokawa; Satoshi Aita; Isao Watanabe; Hidenori Takayasu; Hiroshi Udo, all of Ibaraki, Japan

[73] Assignee: Hitachi Koki Co., Ltd., Tokyo, Japan

[21] Appl. No.: 956,790

[22] Filed: Oct. 23, 1997

[30] Foreign Application Priority Data

Oct. 25, 1996 [JP] Japan ..... 8-283737
Sep. 12, 1997 [JP] Japan ..... 9-248388

[51] Int. Cl.[6] ..... G03G 15/20

[52] U.S. Cl. ..... 399/69; 219/216; 219/470; 399/334; 432/60

[58] Field of Search ..... 399/67, 69, 70, 399/328, 330, 331, 334; 219/216, 469, 470; 432/60; 118/60

[56] References Cited

U.S. PATENT DOCUMENTS 4,001,545 1/1977 Wada et al. ..... 219/216
4,301,359 11/1981 Ito et al. ..... 219/469
4,309,591 1/1982 Kanoto et al. ..... 219/216
4,585,325 4/1986 Euler ..... 399/69
5,241,159 8/1993 Chatteriee et al. ..... 219/470
5,666,593 9/1997 Amico ..... 399/69

FOREIGN PATENT DOCUMENTS 61-6385 2/1986 Japan .

*Primary Examiner*—William Royer
*Attorney, Agent, or Firm*—Sughrue, Mion, Zinn, Macpeak & Seas, PLLC

[57] ABSTRACT

A a fixing apparatus for an electrophotographic apparatus includes a heat roller (11*a*) having a heater (14) therein and a pressure roller (11*b*) urged against the heat roller, wherein a recording material (6) holding a toner image (25) thereon is sandwiched and carried while being heated and pressurized at a pressing portion between the heat roller and the pressure roller thereby to fix the toner image on a surface of the recording material, the fixing apparatus further including a first temperature detecting mechanism (18) formed by a temperature detecting element (15) provided at a portion of an outer periphery of the heat roller and a sensor head (17) disposed so as to be able oppose to the temperature detecting element, a second temperature detecting mechanism (19) formed by a plurality of temperature detecting elements disposed at a constant interval therebetween along an axial direction of the heat roller and spaced from the outer periphery of the heat roller, and a control mechanism (20, 21, 22, 23, 24) for controlling turning-on and turning-off of the heater in accordance with either one of outputs from the first and second temperature detecting mechanism.

5 Claims, 2 Drawing Sheets

FIXING APPARATUS AND METHOD FOR ELECTROPHOTOGRAPHIC APPARATUS INCLUDING TEMPERATURE DETECTING MECHANISM FOR HEAT ROLLER

BACKGROUND OF THE INVENTION

1. Field of the Invention

The present invention relates to a fixing apparatus and a fixing method for an electrophotographic apparatus.

2. Description of the Related Art

In a fixing apparatus for an electrophotographic apparatus which includes both a heat roller having heaters therein and a pressure roller urged against the heat roller, and which sandwiches and carries recording material holding a toner image on the surface thereof while heating and pressurizing the recording material at a pressing portion between the heat roller and the pressure roller, thereby to fix the toner image on the surface of the recording material, it is required to apply a constant value of heat to the toner image so as to obtain a stable fixing intensity of the toner image.

The conventional heat control system for a heat roller is arranged in the following manner (see JP-B 61-6385). For example, a temperature detecting element is provided at a portion of the outer periphery of the heat roller and a sensor head is provided so as oppose to the temperature detecting element. The temperature detecting element detects the temperature of the heat roller, and the sensor head outputs a signal when it opposes the temperature detecting element. Then, it is determined whether or not the heaters of the heat roller are to be supplied with current in accordance with the signal from the sensor head, thereby controlling the temperature of the heat roller.

In the aforesaid configuration of the conventional temperature detecting means, however, since the temperature detecting element is provided at the end portion (non-running area of a sheet) of the heat roller along the axial direction thereof, it was impossible to directly measure the temperature at the center portion (sheet running area) of the heat roller along the axial direction thereof. Accordingly, even in a case where the temperature of the sheet running area of the heat roller decreases due to the heat absorption function of the toner and the recording material (sheet etc.) and hence the temperature distribution state of the heat roller becomes as shown in FIG. 5, for example, it is impossible to detect such a state. As a consequence, it was impossible to obtain a stable fixing intensity of the toner image.

SUMMARY OF THE INVENTION

An object of the present invention is to provide a fixing apparatus and a fixing method for an electrophotographic apparatus capable of keeping the temperature of the heat roller along the axial direction thereof constant and obtaining a stable fixing intensity.

In order to achieve the aforesaid object, the fixing apparatus for an electrophotographic apparatus includes a heat roller having a heater therein and a pressure roller urged against the heat roller, wherein a recording material holding a toner image thereon is sandwiched and carried while being heated and pressurized at a pressing portion between the heat roller and the pressure roller, thereby to fix the toner image on a surface of the recording material, the fixing apparatus further including a first temperature detecting means formed by a temperature detecting element provided at a portion of outer periphery of the heat roller and a sensor head disposed so as to be able to oppose to the temperature detecting element, a second temperature detecting means formed by a plurality of temperature detecting elements disposed at a constant interval therebetween along an axial direction of the heat roller and spaced from the outer periphery of the heat roller, and a control means for controlling turning-on and turning-off of the heater in accordance with either one of outputs from the first and second temperature detecting means.

The above and other objects and features of the present invention will be more apparent from the following description taken in conjunction with the accompanying drawings.

DETAILED DESCRIPTION OF THE PREFERRED EMBODIMENTS

Now, an embodiment of the present invention will be described with reference to the accompanying drawings.

Figure 1:
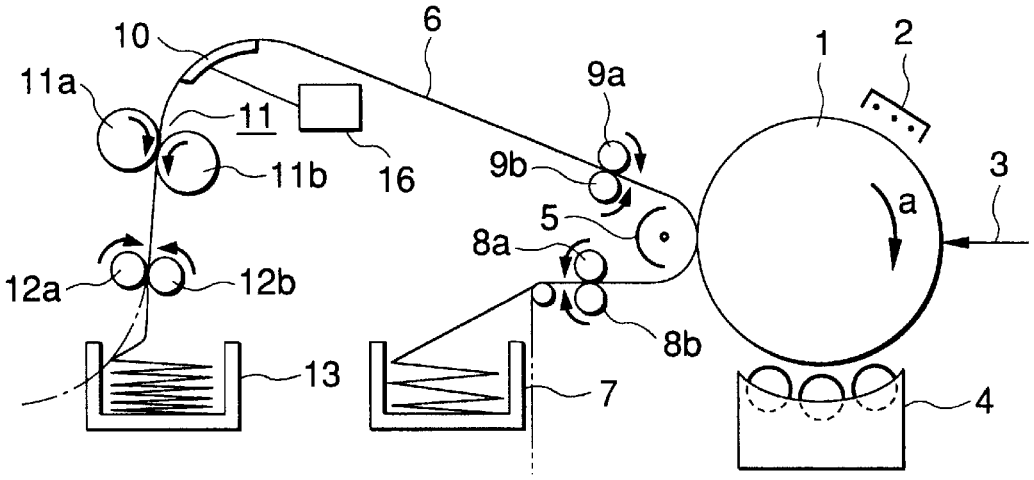
FIG. 1 is a schematic diagram showing the entire arrangement of an electrophotographic apparatus.

In FIG. 1, a reference numeral 1 depicts a photosensitive drum which forms a toner image thereon through the electrophotographic process and is supported by a supporting axis so that the photosensitive drum 1 rotates in the direction shown by an arrow a at a constant speed. A charger 2 is disposed to oppose to the surface of the photosensitive drum 1 thereby to uniformly charge the surface of the photosensitive drum 1 which passes the charger 2 in opposite relation. A laser beam 3, for exposing the surface of the photosensitive drum 1 which is charged uniformly, is modulated by a print information signal supplied from an information processing apparatus thereby to form an electrostatic latent image on the surface of the photosensitive drum 1. A development apparatus 4 is disposed to oppose the surface of the photosensitive drum 1 on which the electrostatic latent image is formed. The development apparatus 4 has a developing function that powder toner are made adhered to the surface of the photosensitive drum 1 by the electrostatic power of the electrostatic latent image, thereby to form a toner image.

A sheet hopper 7 receives, in a folded state, a continuous recording material (printing sheet) 6 of belt-like configuration to which the toner image is transferred and fixed thereby to perform image printing thereon. Transfer rollers 8*a*, 8*b* forming a part of a print sheet transfer means take in the print sheet 6 from the hopper 7 and send to the photosensitive drum 1.

The print sheet 6 sent out from the transfer rollers 8*a*, 8*b* is made in contact with the surface of the photosensitive drum 1 so that the toner image is transferred to the surface of the print sheet from the photosensitive drum 1. A transfer unit 5 applies electric charge, whose polarity is opposite to that of the toner image, to the rear surface of the print sheet 6 being in contact with the photosensitive drum 1, thereby to generate on the rear surface of the print sheet 6 an electrostatic force for moving (transferring) the toner image formed on the surface of the photosensitive drum 1 to the surface of the print sheet 6.

Transfer rollers 9*a*, 9*b* forming the other part of the print sheet transfer means send the print sheet 6, on which the toner image has been transferred, to a preheater 10. The preheater 10 is disposed at the upstream side of fixing rollers 11 and made in contact with the rear surface of the print sheet 6 holding the toner image thereon, thereby to preheat the print sheet 6.

The preheater 10 is arranged for example in a manner that an electric heater is mounted to the rear surface of a heat transfer member with which the rear surface of the print sheet 6 contacts. The preheater 10 heats the print sheet 6 to such a degree that the toner image adhered to the print sheet 6 is softened while the print sheet 6 moves in a state of being in contact with the surface of the preheater 10. The temperature of the preheater 10 can be adjusted by controlling the current supplied to the electric heater by a temperature control device 16.

The pair of fixing rollers 11 formed by a heat roller 11*a*and a pressure roller 11*b* urged against the heat roller 11*a* heat and pressurize the print sheet 6 which was made in contact with the preheater 10 and preheated, thereby fixing the toner image on the surface of the print sheet 6. The print sheet 6 sent from the fixing rollers 11 is pulled in by puller rollers 12*a*, 12*b* and then folded and received within a stacker 13. Alternatively, the print sheet pulled in the puller rollers is ejected out of the electrophotographic apparatus and then sent to another electrophotographic apparatus or a post processing apparatus (not shown) disposed at the rear stage of this electrophotographic apparatus.

Figure 2:
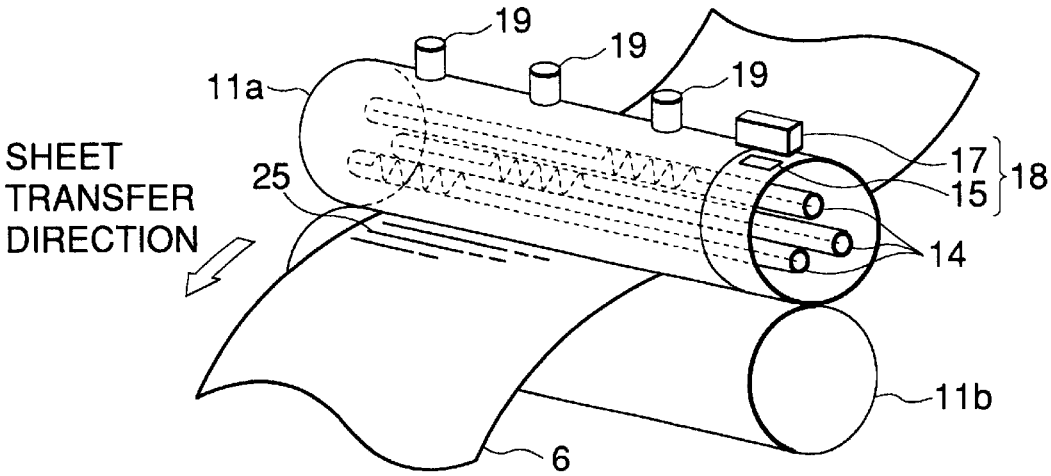
FIG. 2 is a perspective view showing the main part of the fixing apparatus according to the present invention.

FIG. 2 shows the detailed configuration of the fixing apparatus according to the present invention.

In FIG. 2, a plurality of heaters 14 respectively having different heat areas are provided within the heat roller 11*a*. A temperature detecting element 15 such as a thermo-write chip is pasted at the end portion of the outer periphery of the heat roller 11*a* along the axial direction thereof. A sensor head 17 is disposed so as to be able to oppose the temperature detecting element 15. A first temperature detecting means 18 is formed by the temperature detecting element 15 and the sensor head 17. At the vicinity of the center portion of the heat roller 11*a* along the axial direction thereof, there is provided a second temperature detecting means 19 which is formed by a plurality of thermistors etc. disposed with a constant distance from the outer periphery of the heat roller 11*a*. The second temperature detecting means 19 is provided in correspondence with the heat areas of the heaters 14.

In FIG. 2, a reference numeral 25 depicts a toner image formed on the print sheet 6.

Figure 3:
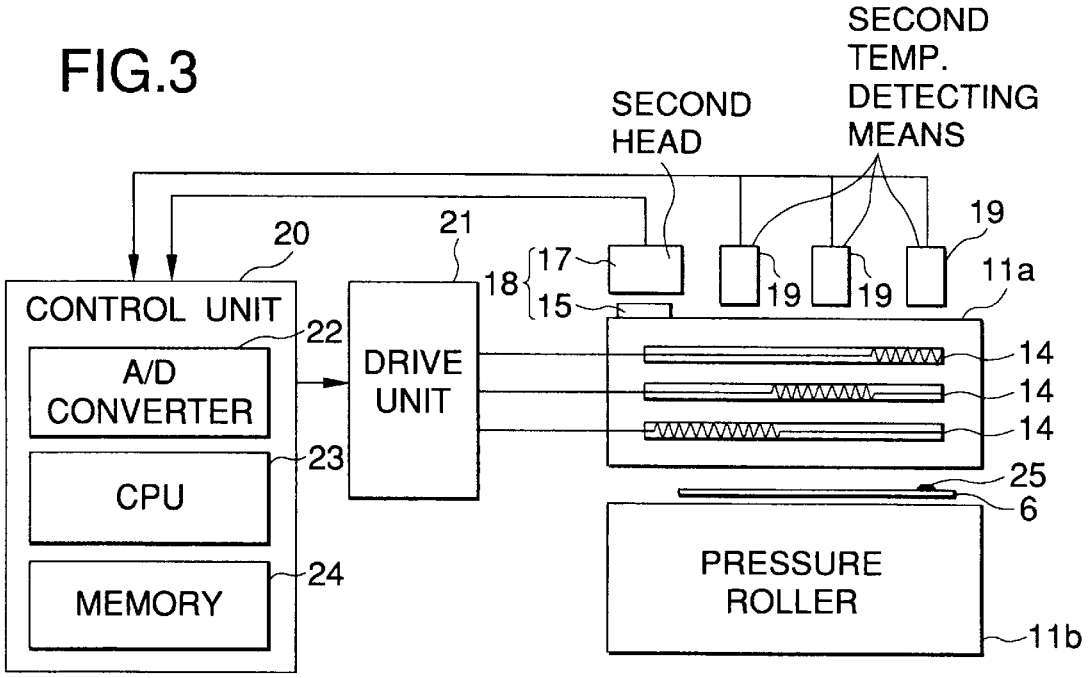
FIG. 3 is a block diagram of the control system of the fixing apparatus according to the present invention.

The operation of this fixing apparatus will be explained with reference to FIG. 3.

In the aforesaid configuration, when a power switch for the electrophotographic apparatus serving as a printer is turned on to start the printer, the heat roller 11*a* starts rotating. In this state, the sheet transferring operation is stopped and the sheet is not made in contact with the heat roller.

When the heat roller 11*a* rotates, a signal is outputted from the sensor head at a constant period each time the temperature detecting element 15 opposes the sensor head 17. When the detecting temperature of the temperature detecting element 15 has been set at 180° C., for example, the aforesaid signal is kept to be outputted at the constant period until the detected temperature reaches 180° C. but stopped when the detected temperature reaches 180° C. The surface temperature of the heat roller 11*a* becomes stable after the lapse of the predetermined time from a time point where the detected temperature reaches 180° C. In this respect, the predetermined time can be set to an arbitrary time by taking the overshoot etc. of the signal outputted immediately after the detected temperature reached 180° C. into consideration. Of course, the heat areas of the heaters 14 are set by taking into consideration that the temperature distribution becomes uniform in a state that the detected temperature has reached and is stably kept at 180° C.

Figure 4:
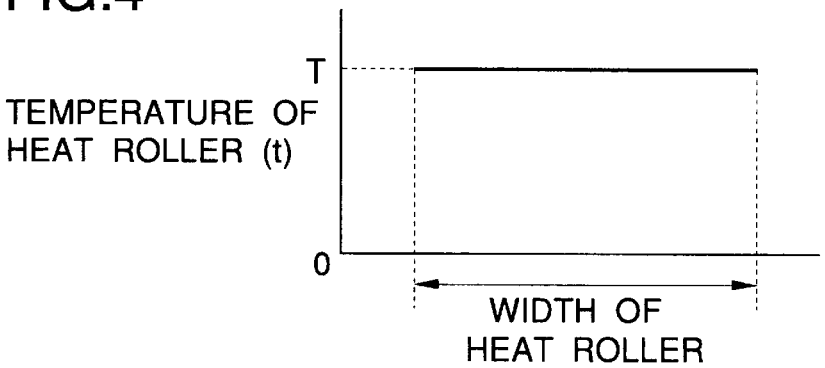
FIG. 4 is an explanatory diagram showing the temperature distribution of the heat roller along the axial (longitudinal) direction thereof.
Figure 5:
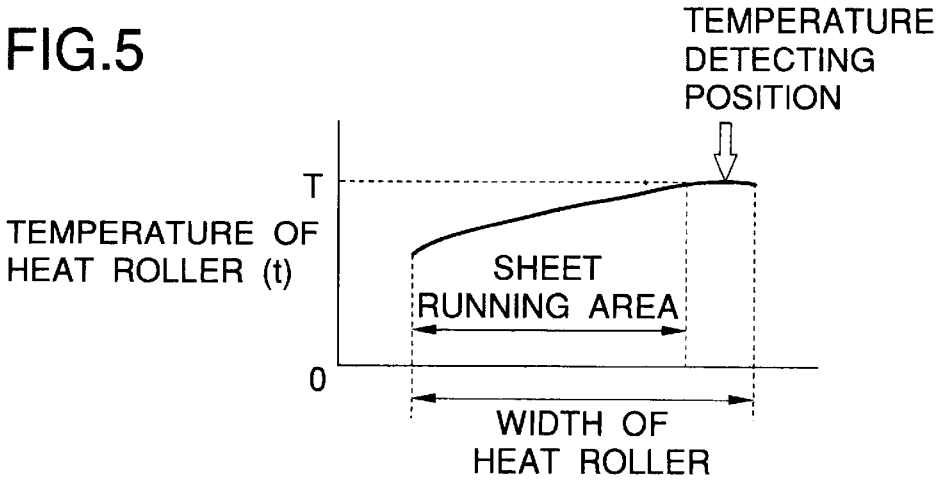
FIG. 5 is an explanatory diagram showing the temperature distribution of the heat roller along the axial (longitudinal) direction thereof.

As described above, a control unit 20 sends a heater drive signal to a drive unit 21 only in accordance with the output value of the first temperature detecting means 18 thereby to turn on and off the heaters 14, thereby controlling the heat roller 11*a* so as to maintain an ideal temperature distribution as shown in FIG. 4.

Then, the output values of the second temperature detecting means 19 at this time are respectively converted into digital values from analog values by an analog-to-digital (A/D) converter 22 of the control unit 20, then fetched into a CPU 23 and stored into a memory 24.

In brief, even if the surface temperature of the heat roller 11*a* reaches 180° C., due to the variations of the resistance values of the respective temperature detecting means (thermistors) 19 themselves, the variations of the distance between the surface of the heat roller 11*a* and the thermistors 19, etc., the output values of the respective thermistors 19 in the ideal temperature distribution state of the heat roller vary in the following manner. That is, the output value of the first thermistor is 3.0 volt, the output value of the second thermistor is 2.9 volt, and the output value of the third thermistor is 2.5 volt, for example.

In this respect, according to the present invention, the output values of the respective thermistors are stored in the memory 24 in advance. Then, at the time of performing the printing operation (that is, in a state where a sheet is sandwiched and carried while being heated and pressurized by the heat roller and the pressure roller), the control unit 20 sends the heater drive signal to the drive unit 21 thereby to turn on and off the heaters 14 so that the output values of the second temperature detecting means 19 become equal to the output values stored in the memory 24 in advance.

According to such an arrangement, the heat roller 11*a* can be realized to have the ideal temperature distribution shown in FIG. 4 without being influenced by the variations of the output values of the thermistors due to the variations of the resistance values of the thermistors used as the second temperature detecting means 19, the variations of the distance between the outer periphery surface of the heat roller 11*a* and the temperature detecting means, etc. Accordingly, it becomes possible to apply a constant heat value to the toner thereby to obtain a stable fixing intensity.

As described above, according to the present invention, it is possible to provide a fixing apparatus and a fixing method for an electrophotographic apparatus capable of keeping the temperature of the heat roller along the axial direction thereof constant and obtaining a stable fixing intensity.

The foregoing description of a preferred embodiment of the invention has been presented for purposes of illustration and description. It is not intended to be exhaustive or to limit the invention to the precise form disclosed, and modifications and variations are possible in light of the above teachings or may be acquired from practice of the invention. The embodiment was chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. A fixing apparatus for an electrophotographic apparatus comprising:

a heat roller having at least one heater therein and a pressure roller urged against said heat roller, wherein recording material holding a toner image thereon is sandwiched and carried while being heated and pressurized at a pressing portion between said heat roller and said pressure roller to fix the toner image on a surface of said recording material;

first temperature detecting means including a temperature detecting element provided at a portion of an outer periphery of said heat roller and a sensor head disposed so as to be able oppose to said temperature detecting element;

second temperature detecting means comprising a plurality of temperature detecting elements disposed at a constant interval therebetween along an axial direction of said heat roller and spaced from the outer periphery of said heat roller; and control means for controlling turning-on and turning-off of said heater in accordance with either one of outputs from said first and second temperature detecting means.

2. A fixing apparatus for an electrophotographic apparatus according to claim 1, wherein said control means includes a memory means for storing output values of said second temperature detecting means corresponding to a temperature distribution of said heat roller along an axial direction thereof at an arbitrary time point.

3. A fixing apparatus for an electrophotographic apparatus according to claim 2, wherein said control means includes means for reproducing the temperature distribution of said heat roller on the basis of the temperature distribution data stored in said memory means in advance.

4. A fixing apparatus for an electrophotographic apparatus comprising:

a heat roller having therein a plurality of heaters with different heating areas respectively and a pressure roller urged against said heat roller, wherein a recording material holding a toner image thereon is sandwiched and carried while being heated and pressurized at a pressing portion between said heat roller and said pressure roller thereby to fix the toner image on a surface of said recording material;

control means for controlling turning-on and turning-off of said plurality of heaters;

first temperature detecting means including a temperature detecting element fixed at an end portion of outer periphery of said heat roller and a sensor head disposed so as to be able to oppose to said temperature detecting element;

second temperature detecting means including a plurality of temperature detecting elements which are provided in correspondence with said respective heating areas of said plurality of heaters, disposed at a constant interval therebetween along an axial direction of said heat roller and supported so as to be spaced from the outer periphery of said heat roller; and memory means for storing outputs of said second temperature detecting means.

5. A fixing method for an electrophotographic apparatus including a heat roller having a plurality of heaters with different heating areas respectively; a control means for controlling turning-on and turning-off of said plurality of heaters; first temperature detecting means formed by a temperature detecting element fixed at an end portion of an outer periphery of said heat roller and a sensor head disposed so as to be able oppose said temperature detecting element; second temperature detecting means formed by a plurality of temperature detecting elements which are provided in correspondence with said respective heating areas of said plurality of heaters, disposed at a constant interval therebetween along an axial direction of said heat roller and supported so as to be spaced from the outer periphery of said heat roller; and memory means for storing outputs of said second temperature detecting means, said fixing method comprising the steps of:

an ideal temperature distribution forming step of controlling turning-on and turning-off of said plurality of heaters before performing a printing operation thereby to obtain uniform temperature distribution in said heat roller;

a measuring step of measuring, by said second temperature detecting means, temperature of surface of said heat roller in a state where the uniform temperature distribution in said heat roller has been obtained by said ideal temperature distribution forming step; and a storing step for storing measured temperatures obtained by said measuring step in said memory means;

wherein at a time of performing a printing operation, said plurality of heaters are turned on and off in accordance with data stored in said memory means.

* * * * *